US008118134B2

(12) United States Patent
Burghardt et al.

(10) Patent No.: US 8,118,134 B2
(45) Date of Patent: Feb. 21, 2012

(54) FRONT RESONATOR FOR A SPEAKER OF A WIRELESS DEVICE

(75) Inventors: Gunther Burghardt, Bochum (DE); Markus Thrien, Bochum (DE)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 12/544,335

(22) Filed: Aug. 20, 2009

(65) Prior Publication Data

US 2011/0042161 A1 Feb. 24, 2011

(51) Int. Cl.
*H04R 1/28* (2006.01)

(52) U.S. Cl. ..... 181/148; 381/353

(58) Field of Classification Search ..... 181/148, 181/150, 199; 381/334, 335, 337, 345, 350, 381/351, 353
See application file for complete search history.

(56) References Cited

U.S. PATENT DOCUMENTS

| | | | | |
|---|---|---|---|---|
| 5,579,398 | A * | 11/1996 | Ewens | 381/338 |
| 6,522,759 | B1 * | 2/2003 | Mori | 381/150 |
| 6,600,938 | B1 * | 7/2003 | Suzuki | 455/567 |
| 6,658,110 | B1 | 12/2003 | Andersen | |
| 6,758,303 | B2 * | 7/2004 | Zurek et al. | 181/155 |
| 6,785,395 | B1 | 8/2004 | Arneson | |
| 7,058,366 | B2 * | 6/2006 | Patterson | 455/90.3 |
| 7,068,979 | B2 * | 6/2006 | Pedersen et al. | 455/90.3 |
| 7,522,741 | B2 * | 4/2009 | Klein | 381/338 |
| 2002/0051552 | A1 * | 5/2002 | Schott | 381/345 |
| 2006/0018499 | A1 * | 1/2006 | Guyot et al. | 381/347 |
| 2006/0140433 | A1 * | 6/2006 | Castaneda et al. | 381/372 |
| 2007/0147646 | A1 | 6/2007 | Klein | |
| 2007/0242848 | A1 * | 10/2007 | Yang | 381/386 |
| 2008/0149417 | A1 * | 6/2008 | Dinh et al. | 181/145 |

FOREIGN PATENT DOCUMENTS

| | | | |
|---|---|---|---|
| EP | 1865690 | A1 | 12/2007 |
| JP | 2005033723 | A | 2/2005 |

OTHER PUBLICATIONS

EESR, EP09168256.7; dated Mar. 17, 2010.

* cited by examiner

*Primary Examiner* — Jeremy Luks
(74) *Attorney, Agent, or Firm* — Novak Druce + Quigg LLP

(57) ABSTRACT

A front resonator for a speaker of a wireless device, comprising: an enclosure mounted over the speaker and forming with an upper surface of the speaker a front volume for the front resonator; and, a horizontal or approximately horizontal tube formed or mounted on a surface of the enclosure, the tube coupled to the front volume, and the tube having at least one end to emit sound generated by the speaker and passing through the front volume and tube from the wireless device.

18 Claims, 14 Drawing Sheets

FRONT RESONATOR FOR A SPEAKER OF A WIRELESS DEVICE

FIELD OF THE APPLICATION

This application relates to the field of wireless devices, and more specifically, to a front resonator for a speaker of a wireless device.

BACKGROUND

Current wireless mobile communication devices include microprocessors, memory, soundcards, speakers, headphones, and run one or more software applications in addition to providing for voice communications.

One problem with current wireless devices pertains to speaker performance. Speakers in wireless devices require a front resonator to perform properly. The front resonator typically consists of a tube coupled to a front volume which is located in front of the speaker. Sound generated by the speaker travels through the front volume, through the tube, and into the air surrounding the wireless device where it is received by a user's ear. The tube and front volume are sized to obtain a desired frequency response. As such, to achieve a desired level of speaker performance, the size (e.g., length, volume, etc.) of the tube and/or front volume may have to be adjusted. However, an increase in the length of the tube, for example, will increase the thickness of the wireless device thus increasing the overall size of the wireless device, which is not desirable.

A need therefore exists for an improved front resonator for a speaker of a wireless device. Accordingly, a solution that addresses, at least in part, the above and other shortcomings is desired.

BRIEF DESCRIPTION OF THE DRAWINGS

Features and advantages of the embodiments of the present application will become apparent from the following detailed description, taken in combination with the appended drawings, in which.

It will be noted that throughout the appended drawings, like features are identified by like reference numerals.

DETAILED DESCRIPTION OF THE EMBODIMENTS

In the following description, details are set forth to provide an understanding of the application. In some instances, certain software, circuits, structures and techniques have not been described or shown in detail in order not to obscure the application.

Figure 1:
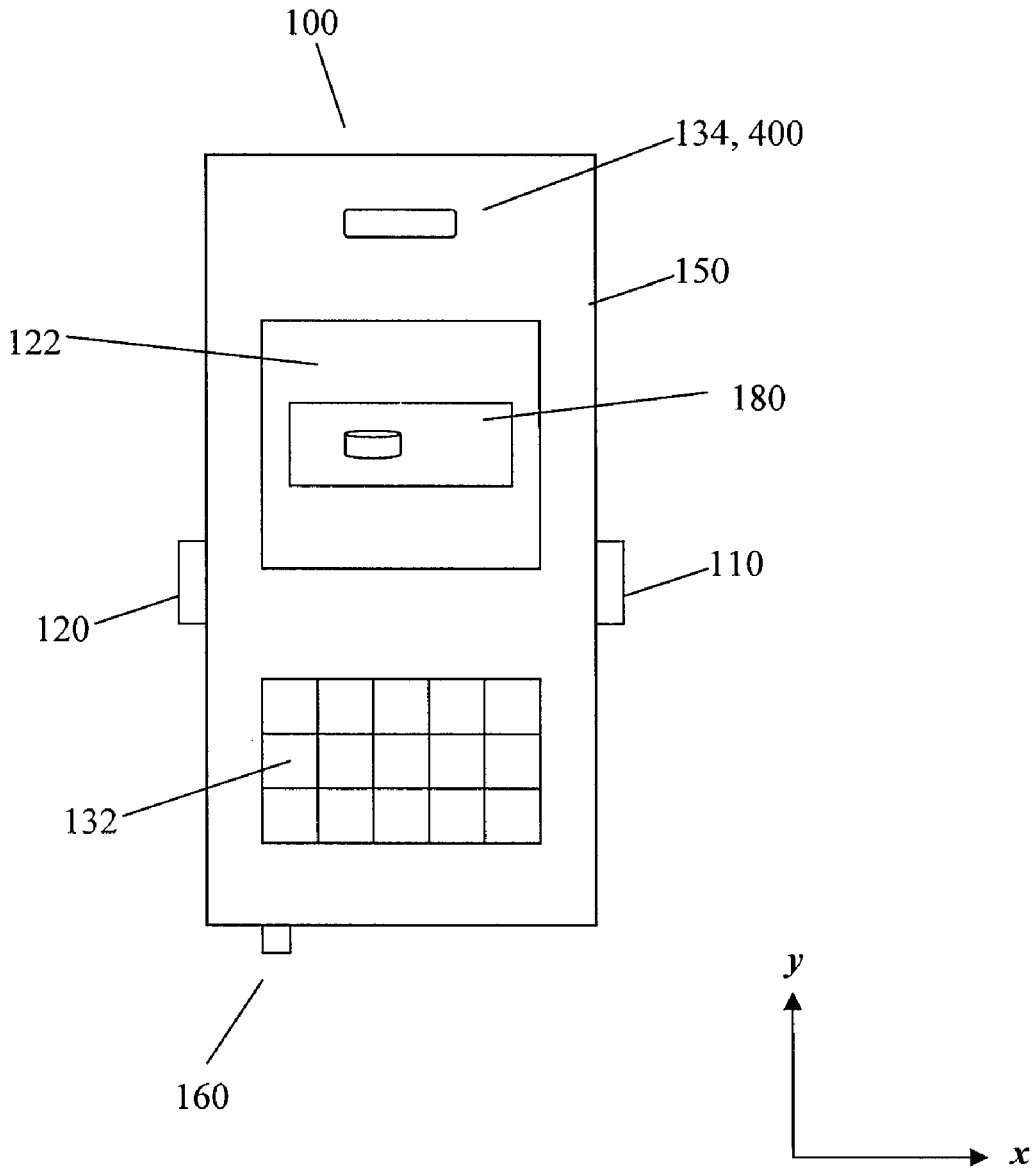
FIG. 1 is a front view illustrating a wireless device in accordance with an embodiment of the application.

FIG. 1 is a front view illustrating a wireless device 100 in accordance with an embodiment of the application. The wireless device 100 includes a cover or case 150, a display (e.g., a liquid crystal display ("LCD")) 122, a graphical user interface ("GUI") 180 displayed on the display 122, a speaker 134, a keyboard (or keypad) 132, a thumbwheel (or trackwheel) 110, various select buttons 120, and various inputs/outputs (e.g., power connector jack, data interface ports, headphones jack, etc.) 160. Internally, the wireless device 100 typically includes one or more circuit boards (not shown in FIG. 1), a CPU 138, memory 124, 126, 200, a battery 156, an antenna (not shown in FIG. 1), etc., which are operatively coupled to the various inputs/outputs 160, the keyboard 132, the display 122, the speaker 134, etc., as will be described below. Further details pertaining to the speaker 134, such as a resonator associated with the speaker 134, will also be described below.

Figure 2:
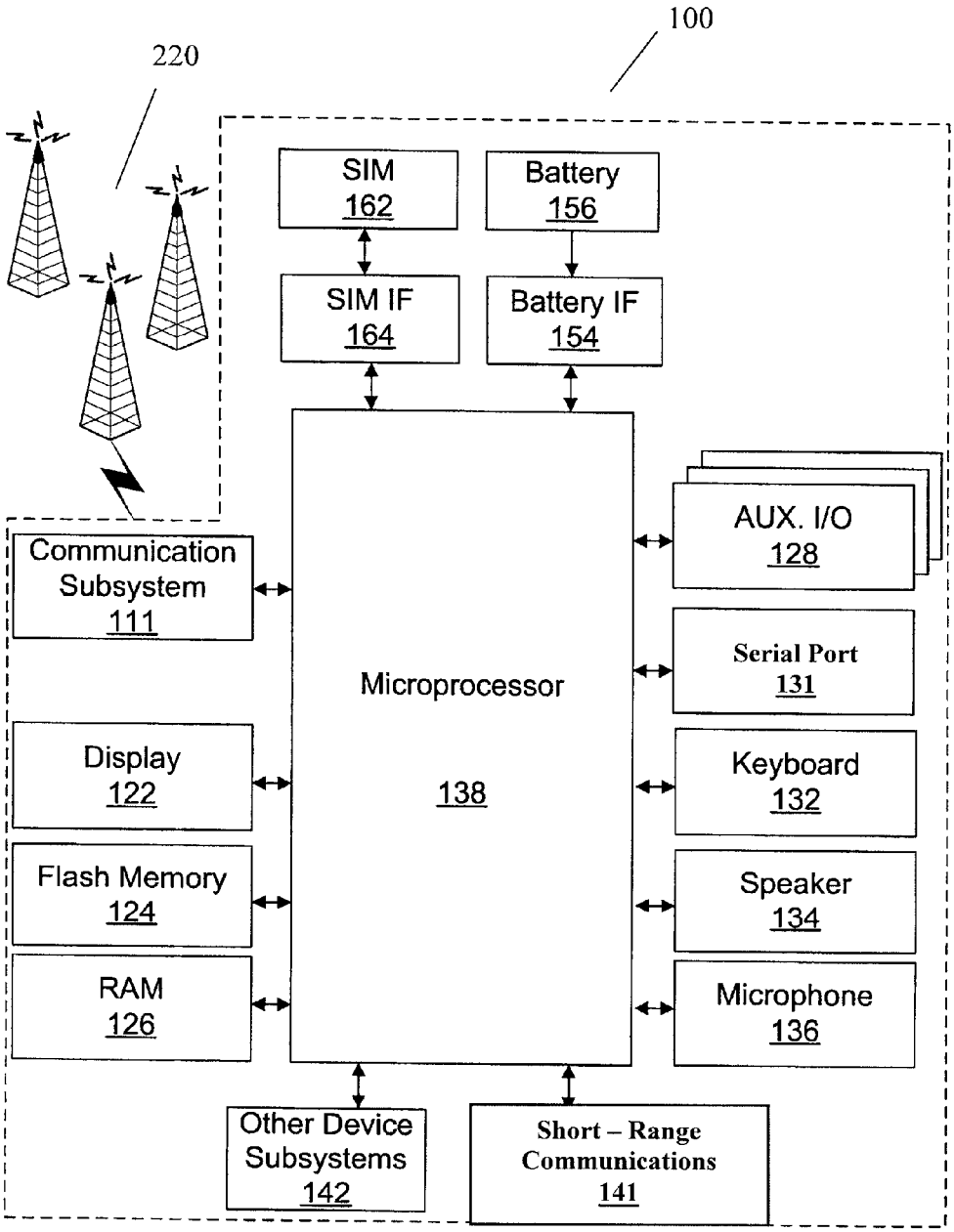
FIG. 2 is a block diagram illustrating the wireless device of FIG. 1.

FIG. 2 is a block diagram illustrating the wireless device 100 of FIG. 1. The wireless device 100 may operate over a wireless network 220. The wireless network 220 may include antenna, base stations, access points, transceivers, supporting radio equipment, etc., as known to those of ordinary skill in the art, for supporting wireless communications between the wireless device 100 and other devices (not shown).

The wireless device 100 may be a two-way communication device having at least voice and advanced data communication capabilities, including the capability to communicate with other devices. Depending on the functionality provided by the device 100, it may be referred to as a data messaging device, a two-way pager, a cellular telephone with data messaging capabilities, a wireless Internet appliance, a data communication device (with or without telephony capabilities), a Wi-Fi device, a WLAN device, a dual-mode (i.e., Wi-Fi and cellular) device, or a portable audio device. The device 100 may communicate with any one of a plurality of transceiver stations (not shown) within its geographic coverage area.

The wireless device 100 may have a communication subsystem 111, a subscriber identity module (or "SIM" card) 162 for inserting into a SIM interface ("IF") 164 in order to operate on a cellular network (e.g., a global system for mobile communication ("GSM") network), a battery IF 154 for receiving one or more rechargeable batteries 156, a microprocessor 138 which controls overall operation of the device 100, a flash memory 124 or other persistent store, a random access memory ("RAM") 126, auxiliary input/output ("I/O") subsystems 128, a serial port (e.g., a universal serial bus ("USB") port) 131, a microphone 136, a short-range communications subsystem 141, and other device subsystems 142.

Figure 3:
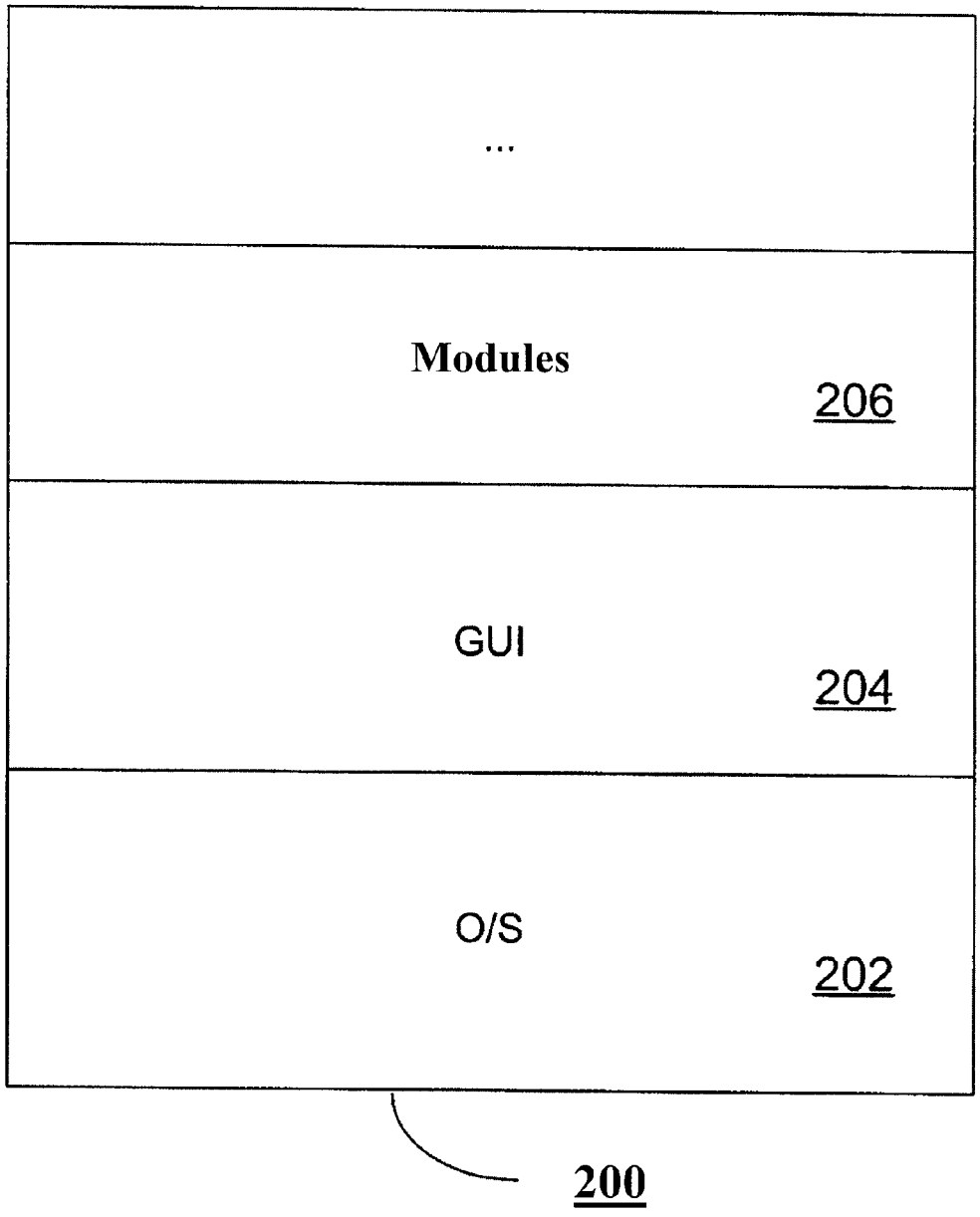
FIG. 3 is a block diagram illustrating a memory of the wireless device of FIG. 1.

FIG. 3 is a block diagram illustrating a memory 200 of the wireless device 100 of FIG. 1. The microprocessor 138 is coupled to the memory 200. The memory 200 has various hardware and software components for storing information (e.g., instructions, data, database tables, test parameters, etc.) for enabling operation of the device 100 and may include flash memory 124, RAM 126, ROM (not shown), disk drives (not shown), etc. In general, the memory 200 may include a variety of storage devices typically arranged in a hierarchy of storage as understood to those skilled in the art. To provide a user-friendly environment to control the operation of the device 100, operating system ("O/S") software modules 202 resident on the device 100 may provide a basic set of operations for supporting various applications typically operable through the GUI 180 and supporting GUI software modules 204. The wireless device 100 may be provided with additional hardware and/or software modules 206 for facilitating and implementing various functions.

Figure 4:
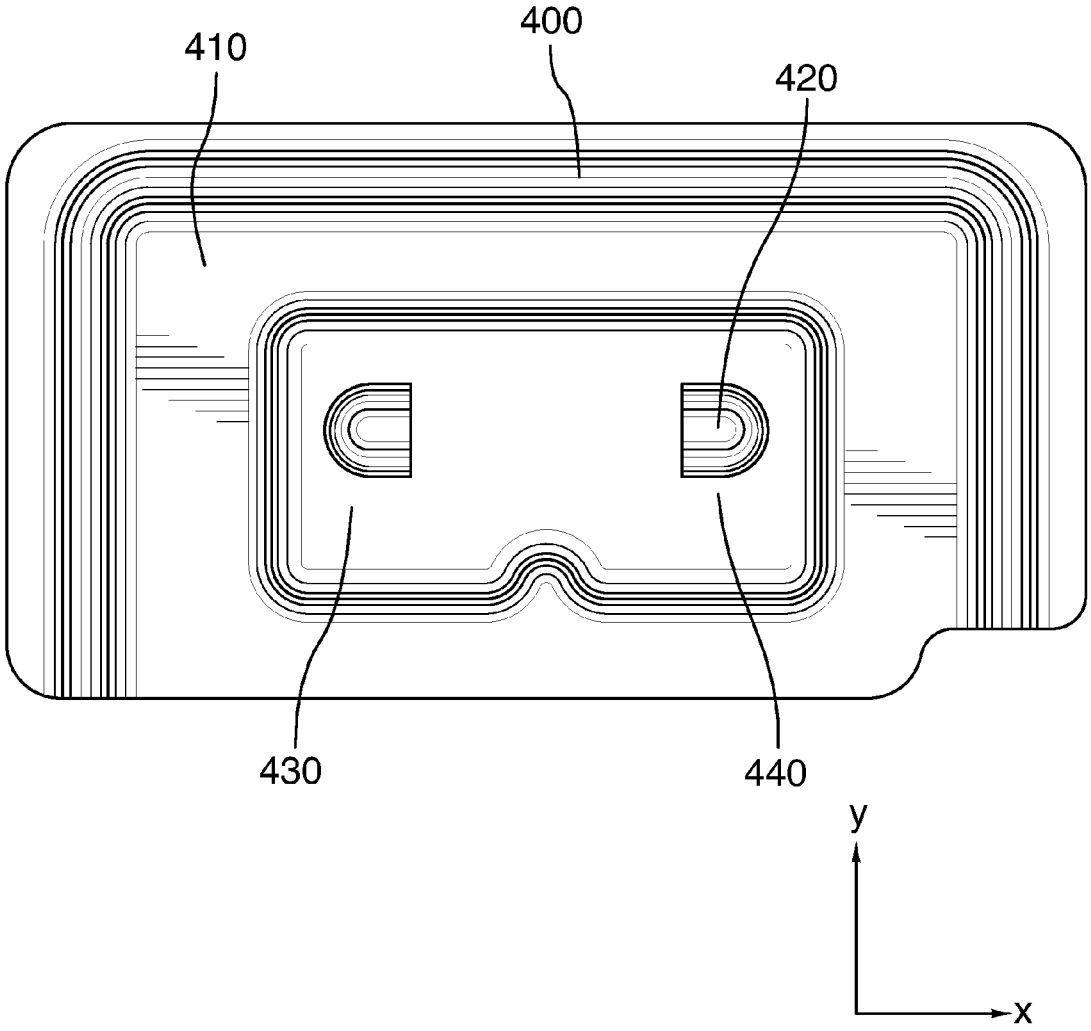
FIG. 4 is a front view illustrating a front resonator for the wireless device of FIG. 1 in accordance with an embodiment of the application.
Figure 5:
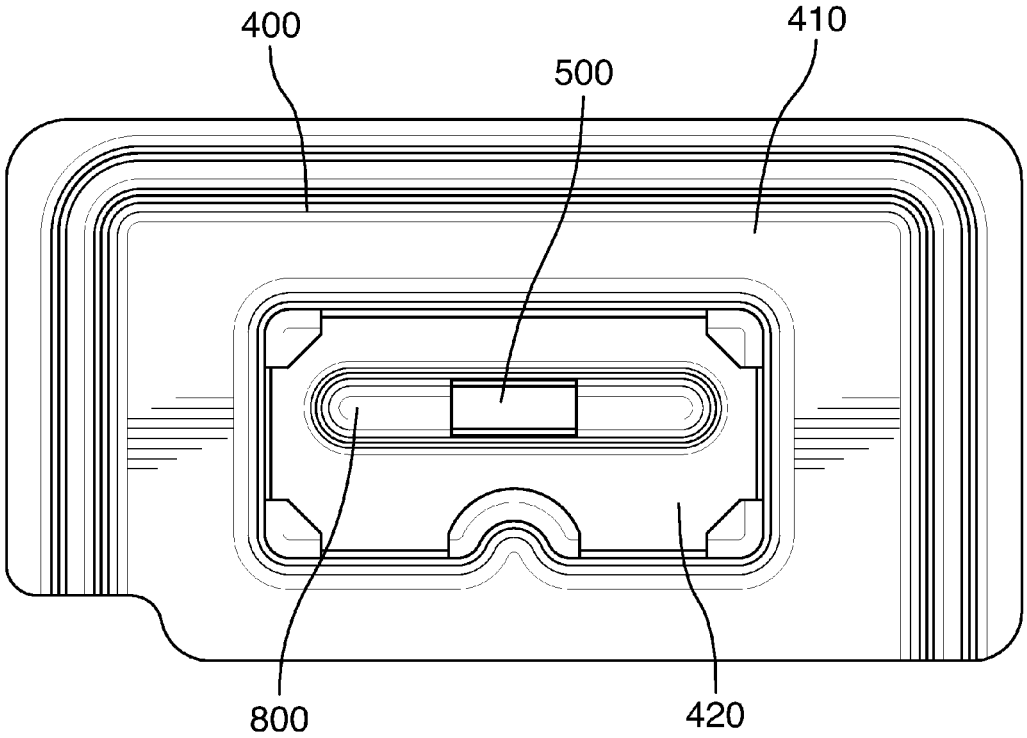
FIG. 5 is a back view illustrating the front resonator of FIG. 4.
Figure 6:
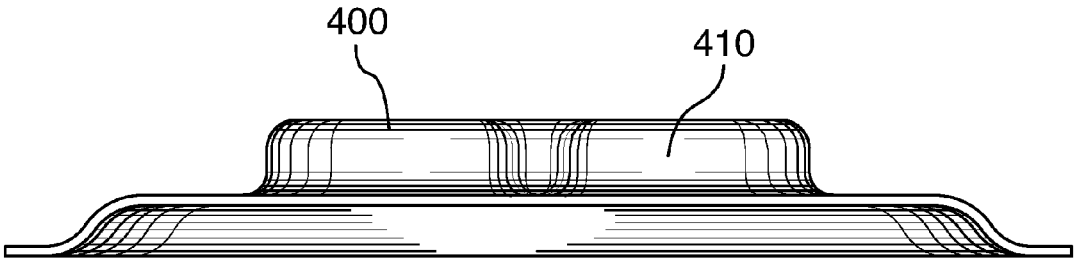
FIG. 6 is a bottom view illustrating the front resonator of FIG. 4.
Figure 7:
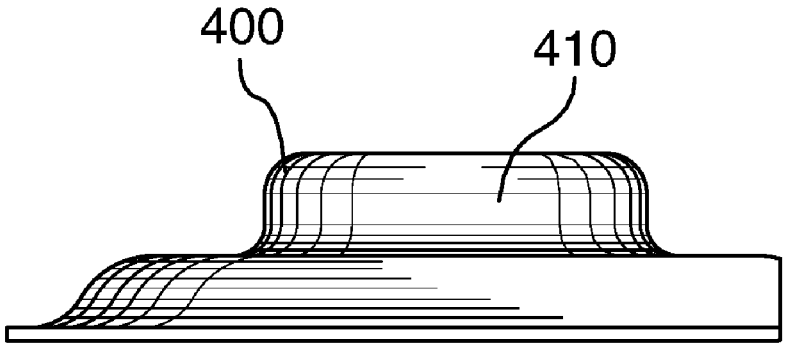
FIG. 7 is a left side view illustrating the front resonator of FIG. 4.
Figure 8:
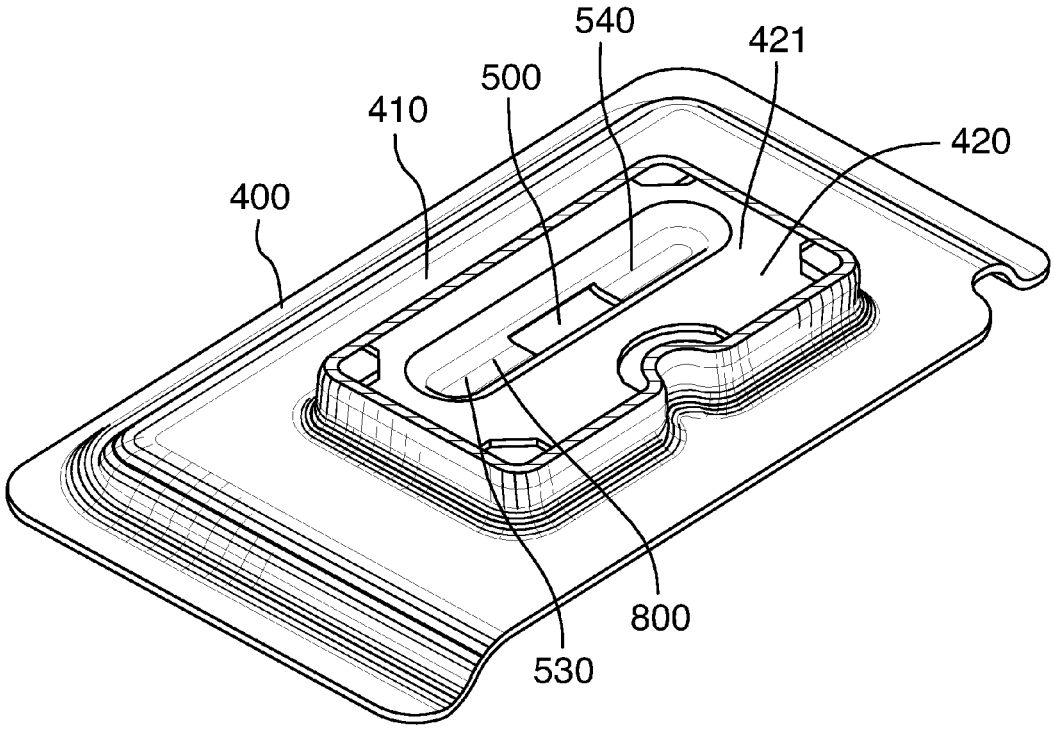
FIG. 8 is a front cross-sectional perspective view illustrating the front resonator of FIG. 4.
Figure 9:
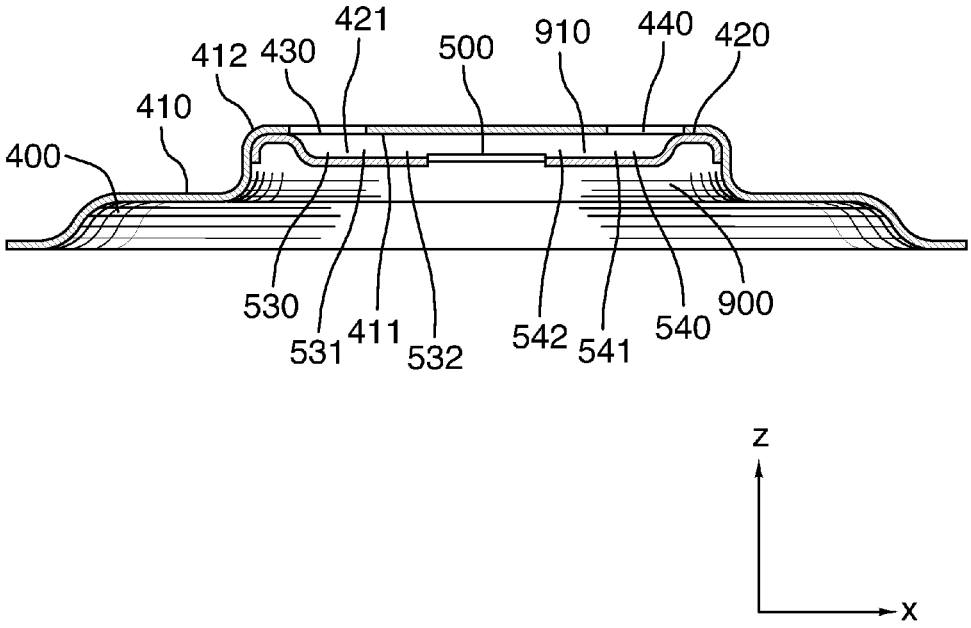
FIG. 9 is a bottom cross-sectional view illustrating the front resonator of FIG. 4.
Figure 10:
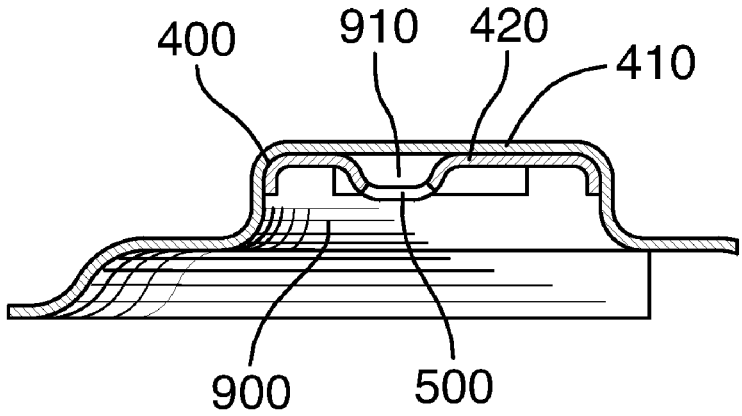
FIG. 10 is a left side cross-sectional view illustrating the front resonator of FIG. 4.

FIG. 4 is a front view illustrating a front resonator 400 for the wireless device 100 of FIG. 1 in accordance with an embodiment of the application. FIG. 5 is a back view illustrating the front resonator 400 of FIG. 4. FIG. 6 is a bottom view illustrating the front resonator 400 of FIG. 4. FIG. 7 is a left side view illustrating the front resonator 400 of FIG. 4. FIG. 8 is a front cross-sectional perspective view illustrating the front resonator 400 of FIG. 4. FIG. 9 is a bottom cross-sectional view illustrating the front resonator 400 of FIG. 4. And, FIG. 10 is a left side cross-sectional view illustrating the front resonator 400 of FIG. 4.

According to one embodiment, the front resonator 400 includes a frame or enclosure 410 into which a panel or plate 420 is inserted. The enclosure 410, plate 420, and an upper surface 1100 of the speaker 134 form a front volume 900 for the speaker 134. The plate 420 has a groove, channel, or trough 800 formed in an upper surface 421 of the plate 420 such that when the plate 420 is inserted into the enclosure 410, a duct, conduit, or tube 910 is formed between an inner surface 411 of the enclosure 410 and the upper surface 421 of the plate 420. An opening 500 formed in the plate 420 proximate the center of the trough 800 couples the tube 910 to the front volume 900. Openings 430, 440 in the enclosure 410 aligned over respective ends 530, 540 of the trough 800 couple the tube 910 to the external environment. In operation, sound generated by the speaker 134 travels through the front volume 900, through the central opening 500 in the plate 420 and into the tube 910, through the tube 910, and out through the openings 430, 440 in the enclosure 410 over each end 530, 540 of the trough 800.

The tube 910 may be considered as including first and second sections (or tubes) 531, 541, each section (or tube) 531, 541 having a first end 530, 540 and an associated opening 430, 440 into the external environment and a second end 532, 542 having an opening 500 into the front volume 900.

Figure 11:
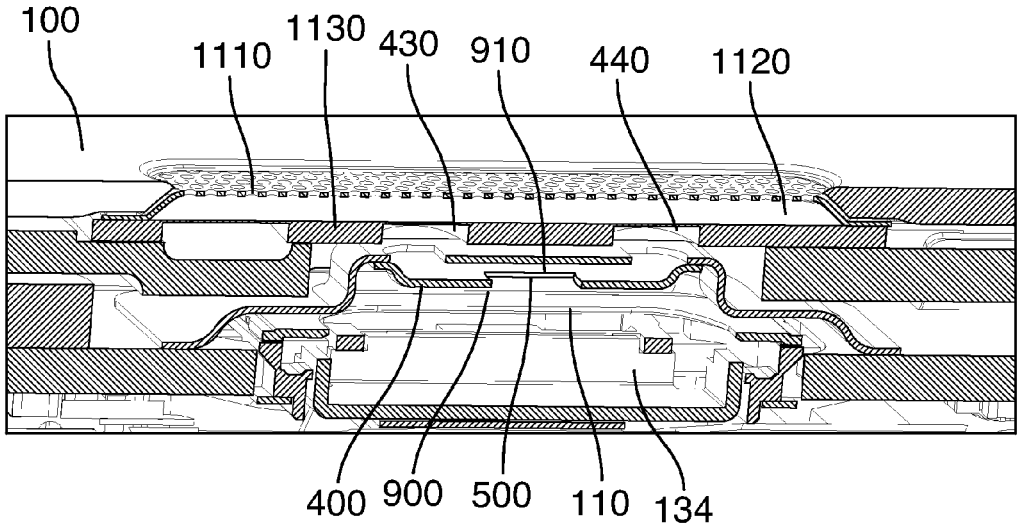
FIG. 11 is a horizontal cross-sectional view illustrating the front resonator of FIG. 4 mounted in the wireless device of FIG. 1.
Figure 12:
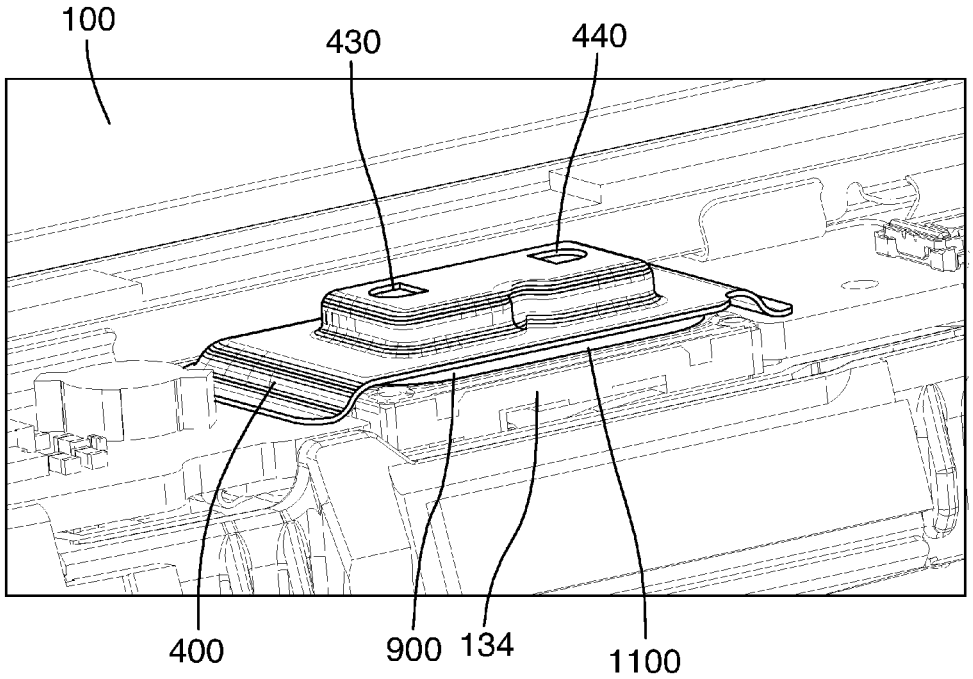
FIG. 12 is a partial cross-sectional perspective view illustrating the front resonator of FIG. 4 mounted in the wireless device of FIG. 1.
Figure 13:
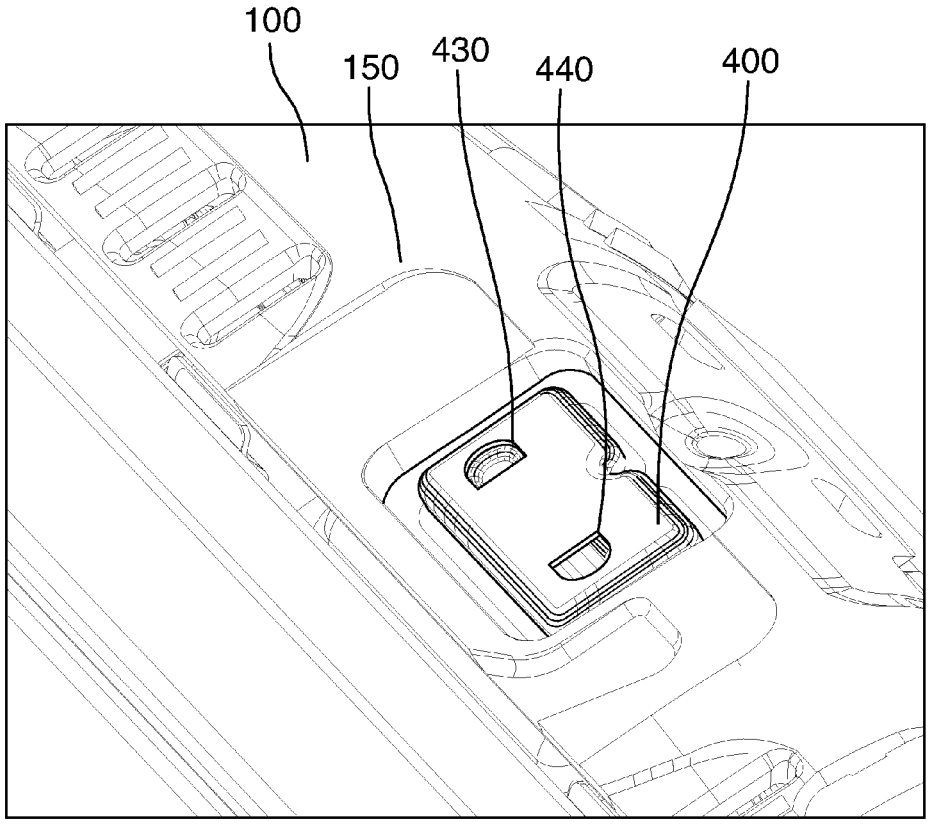
FIG. 13 is a partial perspective view (outlet mesh and foam ring removed) illustrating the front resonator of FIG. 4 mounted in the wireless device of FIG. 1; and, FIG. 14 is a partial perspective view illustrating an outlet mesh and foam ring mounted over the front resonator of FIG. 4 mounted in the wireless device of FIG. 1.
Figure 14:
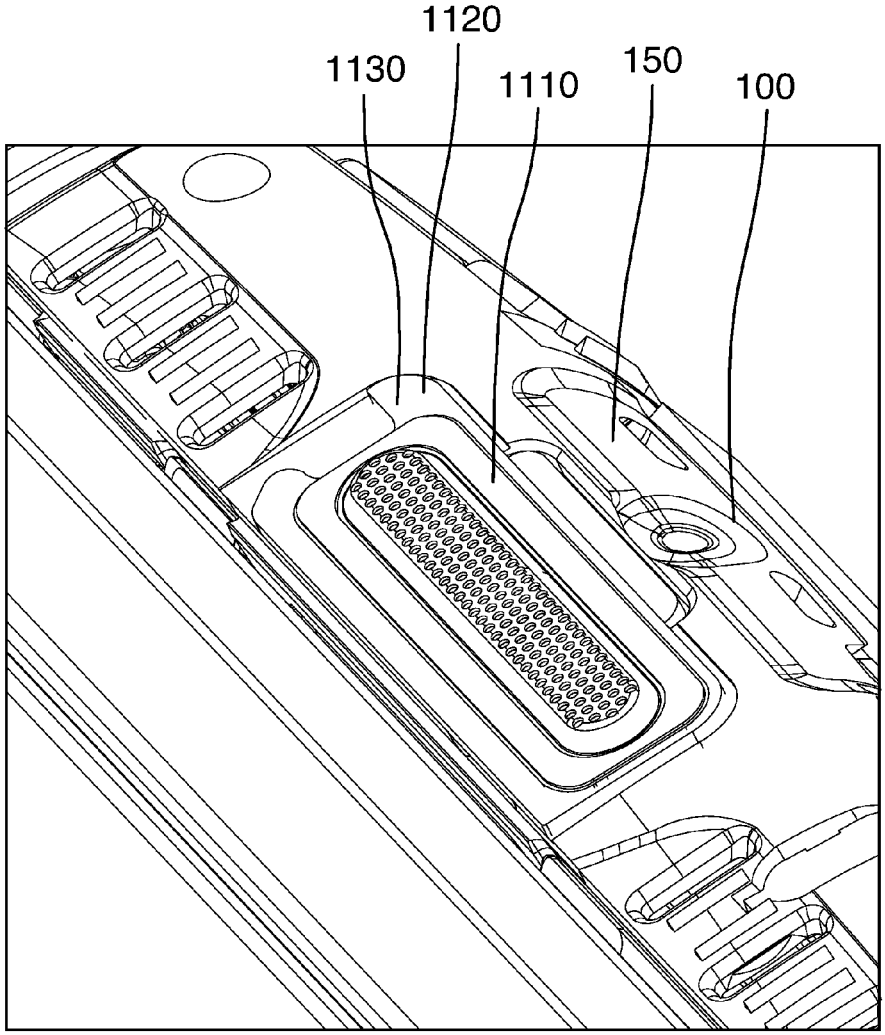

FIG. 11 is a horizontal cross-sectional view illustrating the front resonator 400 of FIG. 4 mounted in the wireless device 100 of FIG. 1. FIG. 12 is a partial cross-sectional perspective view illustrating the front resonator 400 of FIG. 4 mounted in the wireless device 100 of FIG. 1. FIG. 13 is a partial perspective view (outlet mesh 1110, dust net 1120, and foam ring 1130 removed) illustrating the front resonator 400 of FIG. 4 mounted in the wireless device 100 of FIG. 1. And, FIG. 14 is a partial perspective view illustrating an outlet mesh 1110 and foam ring 1120 mounted over the front resonator 400 of FIG. 4 mounted in the wireless device 100 of FIG. 1.

According to one embodiment, a foam ring 1120, dust net 1120, and/or outlet mesh 1110 may be provided over the front resonator 400 when it is mounted in the wireless device 100 to protect the front resonator 400 and speaker 134. According to one embodiment, the speaker 134 is a dynamic speaker (e.g., a cone and magnet speaker). According to one embodiment, the front resonator 400 may be used in conjunction with a microphone or loud speaker. According to one embodiment, the edges of the enclosure 410 and plate 420 are rounded to reduce turbulence and to ease manufacturing tolerances. According to one embodiment, the enclosure 410 and plate 420 are made of metal and are welded or glued together. According to another embodiment, the enclosure 410 and plate 420 may be made of plastic. According to one embodiment, for a frequency response of approximately 4 kHz, each section 531, 541 of the tube 910 is approximately 0.4 mm high, by 1.2 mm wide, by 2.5 mm long and the front volume 900 is approximately 40 $mm^3$. According to one embodiment, the front resonator 400 may include two or more tubes 910. According to one embodiment, the tube 910 may be formed or mounted on an outer surface 412 of the frame or enclosure 410.

Thus, according to one embodiment, there is provided a front resonator 400 for a speaker 134 of a wireless device 100, comprising: an enclosure 410 mounted over the speaker 134 and forming with an upper surface 1100 of the speaker 134 a front volume 900 for the front resonator 400; and, a horizontal (e.g., in the x-y plane) or approximately horizontal tube 910 formed or mounted on a surface (e.g., 411) of the enclosure 410, the tube 910 coupled (e.g., 500) to the front volume 900, and the tube 910 having at least one end 430, 440 to emit sound generated by the speaker 134 and passing through the front volume 900 and tube 910 from the wireless device 100.

The tube 910 may be horizontal (e.g., in the x-y plane) or approximately horizontal with respect to a vertical axis (e.g., the z-axis) of the front volume 900. The tube 910 may be formed or mounted on an inner surface 411 of the enclosure 410. The tube 910 may be formed by a plate 420 having an upper surface 421 mounted to the inner surface 411 of the enclosure 410, the upper surface 421 of the plate 420 having a trough 800 formed therein, the trough 800 and the inner surface 411 of the enclosure 410 forming the tube 910, the trough 800 having an opening 500 formed therein to couple the front volume 900 to the tube 910, the enclosure 410 having at least one opening 430, 440 formed therein and aligned proximate at least one respective end 530, 540 of the trough 800 to emit sound generated by the speaker 134 and passing through the front volume 900 and tube 910 from the wireless device 100. The trough 800 may be straight. The opening 500 in the trough 800 may be formed proximate a center of the trough 800. The opening 500 in the trough 800 may be formed in a bottom of the trough 800. The trough 800 may have a smooth shape with rounded ends. The at least one opening 430, 440 in the enclosure 410 may have semicircular and rectangular portions aligning with at least one respective end 530, 540 of the trough 800. The opening 500 in the trough 800 may have a rectangular shape. The upper surface 421 of the plate 420, the inner surface 411 of the enclosure 410, the trough 800, and a mounting plane of the speaker 134 may be parallel or approximately parallel. A volume of the front volume 900 and a volume of the tube 910 may be selected to provide a frequency response of approximately 4 kHz. The tube 910 may have first and second sections 531, 541. For a frequency response of approximately 4 kHz, each of the first and second sections 531, 541 may be approximately 0.4 mm high, by 1.2 mm wide, by 2.5 mm long and the front volume 900 may be approximately 40 $mm^3$. The enclosure 410 may have a rounded, rectangular, open box-like shape. The inner surface 411 of the enclosure 410 may be an inner upper surface 411 of the enclosure 410. The plate 420 may be mounted in the enclosure 410 by welding or gluing. The enclosure 410 and the plate 420 may be formed from metal or plastic. The speaker 134 may be a cone and magnet speaker. The speaker 134 and front resonator 400 may be mounted within a case 150 of the wireless device 100. The tube 910 may be one or more tubes 910. And, the tube 910 may be formed or mounted on an outer surface 412 of the enclosure 410.

According to another embodiment, there is provided a wireless device 100 having a front resonator 400 as described above.

The above embodiments may contribute to an improved speaker system and may provide one or more advantages. First, the axis of the tube 910, 531, 541 is arranged horizontally with respect to the front volume 900 rather than vertically. As such, the overall height of the front resonator 400 is reduced and hence the overall thickness of the wireless device 100 may also be reduced. For example, if L=tube length and V=front volume, then $L_{new}/L_{old}=V_{old}/V_{new}$. As such, if $V_{new}=0.5\ V_{old}$, then $L_{new}=2\ L_{old}$. In other words, if the front volume is halved, tube length must be doubled which is not generally implementable in the vertical direction in a wireless device. Second, including the tube 910, 531, 541 within the front volume 900 rather than external to the front volume 900, according to one embodiment, allows for a further reduction in the overall thickness of the wireless device 100. Third, being contained within the enclosure 410, according to one embodiment, the tube 910, 531, 541 is physically protected from damage. Fourth, the use of two sections or tubes 531, 541 allows placing tolerances during manufacturing to be less strict (e.g., if one section or tube 531 is a bit longer, the other section or tube 541 will be a bit shorter). Fifth, selected rounding of the edges, corners, and surfaces of the enclosure 410 and plate 420 reduce turbulences and eases manufacturing tolerances. Sixth, the above embodiments may provide one or more of these advantages without significant adverse effect upon speaker performance.

The embodiments of the application described above are intended to be exemplary only. Those skilled in this art will understand that various modifications of detail may be made to these embodiments, all of which come within the scope of the application.

What is claimed is:

1. A front resonator for a speaker of a wireless device, comprising:

an enclosure mounted over the speaker and forming with an upper surface of the speaker a front volume for the front resonator;

a horizontal or approximately horizontal tube formed or mounted on an inner surface of the enclosure, the tube coupled to the front volume, and the tube having at least one end to emit sound generated by the speaker and passing through the front volume and tube from the wireless device;

wherein the tube is horizontal or approximately horizontal with respect to a vertical axis of the front volume; and, wherein the tube is formed by a plate having an upper surface mounted to the inner surface of the enclosure, the upper surface of the plate having a trough formed therein, the trough and the inner surface of the enclosure forming the tube, the trough having an opening formed therein to couple the front volume to the tube, the enclosure having at least one opening formed therein and aligned proximate at least one respective end of the trough to emit sound generated by the speaker and passing through the front volume and tube from the wireless device.

2. The front resonator of claim 1 wherein the trough is straight.

3. The front resonator of claim 2 wherein the opening in the trough is formed proximate a center of the trough.

4. The front resonator of claim 3 wherein the opening in the trough is formed in a bottom of the trough.

5. The front resonator of claim 4 wherein the trough has a smooth shape with rounded ends.

6. The front resonator of claim 5 wherein the at least one opening in the enclosure has semicircular and rectangular portions aligning with at least one respective end of the trough.

7. The front resonator of claim 6 wherein the opening in the trough has a rectangular shape.

8. The front resonator of claim 1 wherein the upper surface of the plate, the inner surface of the enclosure, the trough, and a mounting plane of the speaker are parallel or approximately parallel.

9. The front resonator of claim 1 wherein a volume of the front volume and a volume of the tube are selected to provide a frequency response of approximately 4 kHz.

10. The front resonator of claim 1 wherein the tube has first and second sections.

11. The front resonator of claim 10 wherein, for a frequency response of approximately 4 kHz, each of the first and second sections is approximately 0.4 mm high, by 1.2 mm wide, by 2.5 mm long and the front volume is approximately 40 $mm^3$.

12. The front resonator of claim 1 wherein the enclosure has a rounded, rectangular, open box-like shape.

13. The front resonator of claim 12 wherein the inner surface of the enclosure is an inner upper surface of the enclosure.

14. The front resonator of claim 1 wherein the plate is mounted in the enclosure by welding or gluing.

15. The front resonator of claim 1 wherein the enclosure and the plate are formed from metal or plastic.

16. The front resonator of claim 1 wherein the speaker is a cone and magnet speaker.

17. The front resonator of claim 1 wherein the speaker and front resonator are mounted within a case of the wireless device.

18. The front resonator of claim 1 wherein the tube is one or more tubes.

* * * * *